US006099322A

United States Patent [19]

Beloritsky et al.

[11] Patent Number: 6,099,322

[45] Date of Patent: Aug. 8, 2000

[54] ELECTRICAL RECEPTACLE

[75] Inventors: Victor Beloritsky, North Andover; Satishchandra Shantilal Mistry, Billerica; Robert Saba, Walpole, all of Mass.; Philip Charles Vaccaro, Merrimack, N.H.

[73] Assignee: The Whitaker Corporation, Wilmington, Del.

[21] Appl. No.: 09/023,025

[22] Filed: Feb. 12, 1998

Related U.S. Application Data

[63] Continuation-in-part of application No. 08/962,207, Oct. 31, 1997.

[51] Int. Cl.[7] ..... H01R 12/00

[52] U.S. Cl. ..... 439/63; 439/41; 439/83; 439/884

[58] Field of Search ..... 439/857, 578, 439/579, 580, 581, 582, 583, 585, 856, 63, 83, 41

[56] References Cited

U.S. PATENT DOCUMENTS

| | | | |
|---|---|---|---|
| 3,141,924 | 7/1964 | Forney, Jr. | 174/75 |
| 3,383,457 | 5/1968 | Schumacher et al. | 174/68.5 |
| 3,514,737 | 5/1970 | Renshaw, Jr. | 339/17 |
| 3,915,535 | 10/1975 | O'Keefe et al. | 339/17 |
| 4,545,638 | 10/1985 | Neidich | 439/149 |
| 4,721,481 | 1/1988 | Grellmann et al. | 439/581 |
| 4,737,115 | 4/1988 | Seidler | 439/83 |
| 4,944,691 | 7/1990 | March | 439/516 |
| 4,957,283 | 9/1990 | Kist | 271/90 |
| 4,975,065 | 12/1990 | Rosenberg et al. | 439/63 |
| 4,990,109 | 2/1991 | Romerein et al. | 439/801 |
| 5,024,610 | 6/1991 | French et al. | 439/857 |
| 5,402,315 | 3/1995 | Reichle | 361/784 |
| 5,404,117 | 4/1995 | Walz | 333/34 |
| 5,613,864 | 2/1997 | Northey | 439/787 |
| 5,618,187 | 4/1997 | Goto | 439/79 |
| 5,797,768 | 8/1998 | Francaviglia | 439/567 |
| 5,810,611 | 9/1998 | Campagnon | 439/149 |
| 5,819,404 | 10/1998 | Whiting | 29/843 |

FOREIGN PATENT DOCUMENTS 06251833 9/1994 Japan .

OTHER PUBLICATIONS

Drawing, 05–2.9 Stripline Stress Relief Contact, B4 Omni Spectra, Inc. 1991.

*Primary Examiner*—Paula Bradley
*Assistant Examiner*—Truc Nguyen

[57] ABSTRACT

An electrical contact (6) has a base (18) for surface mount engagement with a circuit board (4), first spring fingers (19) on a first edge of the base (18), and second spring fingers (21) on a second edge of the base (18), the first spring fingers (19) and the second spring fingers (21) projecting upwardly to define respective sides (24, 25) of at least one electrical receptacle (23), and each of the first spring fingers (19) being offset along the base (18) from each of the second spring fingers (21).

4 Claims, 4 Drawing Sheets

ELECTRICAL RECEPTACLE

CROSS REFERENCE TO RELATED APPLICATION

This application is a continuation in part of application, Ser. No. 08/962,207, filed Oct. 31, 1997.

FIELD OF THE INVENTION

The present invention relates to an electrical contact, and more particularly, to an electrical contact for mating connection with a center contact of a coaxial connector.

BACKGROUND OF THE INVENTION

U.S. Pat. No. 3,514,737, discloses a known electrical receptacle for electrical mating connection with a central conductor of a circuit component. The receptacle will compensate for mating misalignment along a Z axis, the Z axis being coincident with the centerline of the central contact. The known electrical receptacle is deficient in the aspect of allowing for mating misalignment along an X axis and a Y axis, which are orthogonal to the Z axis.

SUMMARY OF THE INVENTION

The invention comprises, an electrical contact having an electrical receptacle that compensates for mating misalignment of a center contact of a coaxial connector with the electrical receptacle, along each of X, Y and Z, orthogonal axes.

An advantage of the invention resides in an electrical receptacle that compensates for mating misalignment along any of three orthogonal axes.

An advantage resides in an invention that will compensate for mating misalignment of a center contact of a coaxial connector with an electrical receptacle, which receptacle is suitable, for example, to launch an rf signal from a circuit path on a circuit board. According to an embodiment, the receptacle is suitable to launch an rf microwave signal from a microstrip.

Another advantage of the invention resides in first and second sets of spring fingers defining opposite sides of an electrical receptacle, wherein resiliency of the spring fingers is improved by the spring fingers crossing over one another to opposite sides of the electrical receptacle.

The invention further relates to an electrical contact for launching an rf microwave signal from a microstrip to a coaxial connector on an MIC package, meaning, a microwave integrated circuit package.

The invention further relates to an electrical contact having a vacuum pick up surface substantially at a centroid of a base of the contact to adapt the contact for transport by a vacuum applying tool.

Preferred embodiments of the invention will now be described by way of example with reference to the accompanying drawings, according to which:

DETAILED DESCRIPTION

Figure 1:
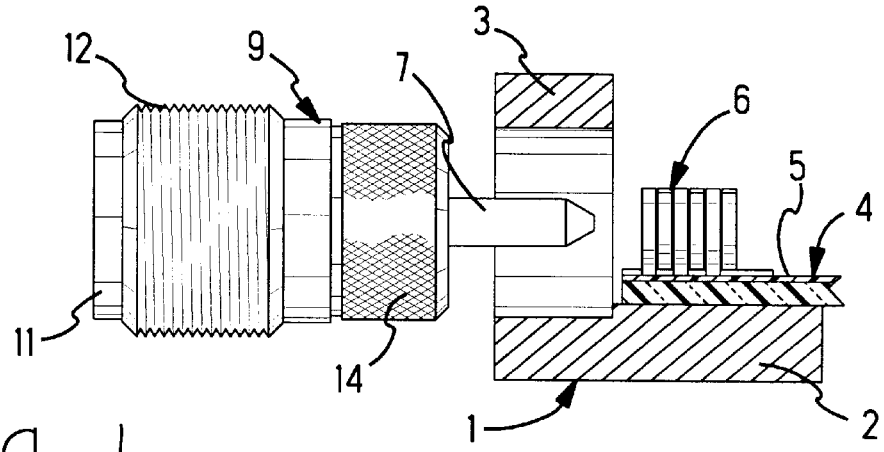
FIG. 1 is a section view of an MIC package, together with an electrical contact mounted on a circuit board, and further illustrating a coaxial connector.

With reference to FIGS. 1–4, embodiments of a conducting MIC package 1 will now be discussed. Each MIC package 1 comprises, a bottom wall 2 and an exterior wall 3. Further, a circuit board 4 is mounted inside the MIC package 1. According to the embodiments of FIGS. 1, 2 and 3, the circuit board 4 is supported by the bottom wall 2. According to the embodiment of FIG. 4, The circuit board 4 is supported by a conducting cover 8 that encloses the MIC package 1.

A conducting circuit path 5 on the circuit board 4 is electrically connected to a conducting electrical contact 6 on the circuit path 5. For example, the circuit path S comprises, a microwave signal path, or microstrip, and the electrical contact 6 comprises a launch for a microwave signal from the circuit path 5 to a center contact 7 of a coaxial connector 9 that is mounted on the exterior wall 3 of the MIC package 1.

With reference to FIGS. 1–4 the coaxial connector 9 is of known construction, for example, comprising, the center contact 7 supported by a concentrically encircling dielectric body 10, in turn, concentrically encircled by a conducting outer shell 11. At an open end of the coaxial connector 9, the outer shell 11 has a disconnect coupling portion 12. Further, at the open end of the coaxial connector 9, the center contact 7 has a disconnect coupling portion 13. A base portion 14 of the shell 11 aligns with an opening 15 through the exterior wall 3, followed by being secured to the exterior wall 3, establishing a ground or earth connection. According to FIGS. 1 and 2, the base portion 14 of the shell 11 is threaded or friction fit within the opening 15, and can be followed by solder joining to the exterior wall 3. According to FIGS. 3 and 4, the base portion 14 of the shell 11 is a transverse flange that secures to the exterior wall 3 with fasteners 16. The center contact 7 projects into the MIC package 1 for mating connection with the electrical contact 6. Thereby, the MIC package 1 is adapted with the coaxial connector 9. The electrical contact 6 launches an rf signal to the coaxial connector 9. The coaxial connector 9 establishes an external coupling for the rf signal and ground or earth.

Figure 5:
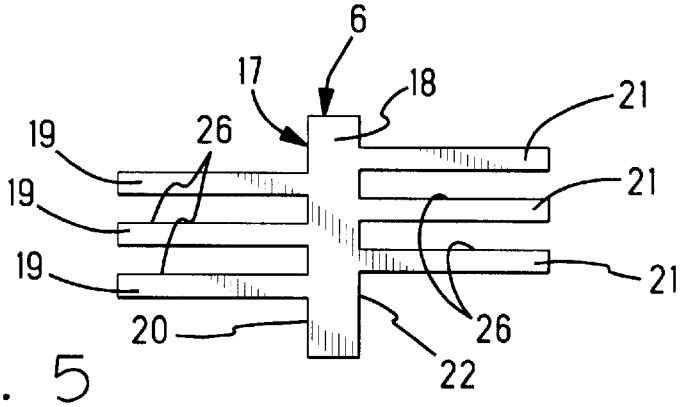
FIG. 5 is a development view of a metal blank prior to being formed to comprise the electrical contact, as shown in FIGS. 1–4.
Figure 6:
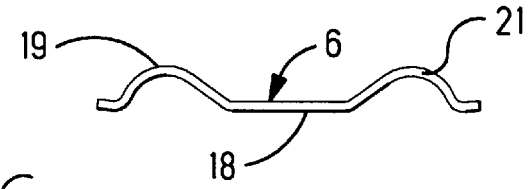
FIG. 6 is an end view of the blank shown in FIG. 5.
Figure 7:
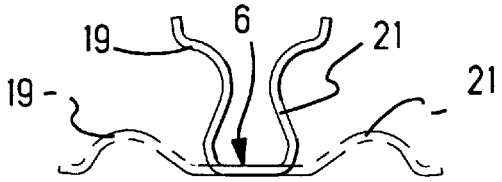
FIG. 7 is view similar to FIG. 6, and illustrating a partly formed blank shown in FIG. 6.

With reference to FIGS. 5–7, further details of the electrical contact 6 will now be described. The electrical contact 6 is stamped and formed from a unitary metal blank 17, FIG.

5, and comprises a base 18 for surface mount engagement with the circuit board 4. The base 18 adapts the electrical contact 6 to be solder joined with the circuit path 5 on the circuit board 4. A series of first spring fingers 19 are on a first edge 20 of the base 18. A series of second spring fingers 21 are on a second edge 22 of the base 18.

Figure 8:
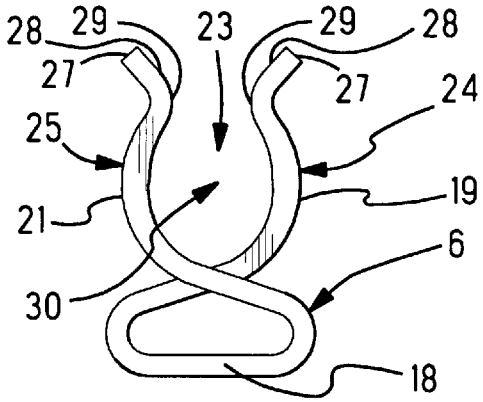
FIG. 8 is an end view of the electrical contact resulting from a fully formed blank, as shown partly formed in FIG. 7.

FIGS. 6–8 disclose progressively formed shapes of the spring fingers 19, 21. FIG. 8 further discloses, the first spring fingers 19 and the second spring fingers 21 projecting upwardly to define an electrical receptacle 23 for mating connection to the center contact 7 of the coaxial connector 9. The first spring fingers 19 define a first side 24 of the receptacle 23. The second spring fingers 21 define a second side 25 of the receptacle 23. Thereby, respective sides 24, 25 of an electrical receptacle 23 extend along the base 18. Further features of the embodiment will now be described.

Figure 10:
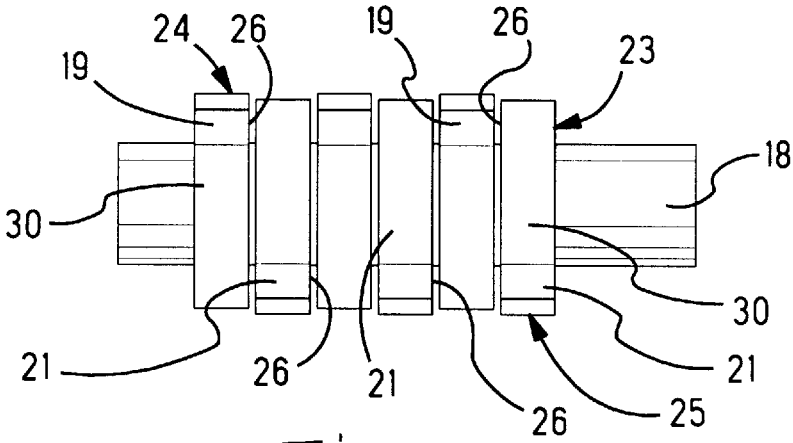
FIG. 10 is a top view of the electrical contact shown in FIGS. 8 and 9.
Figure 9:
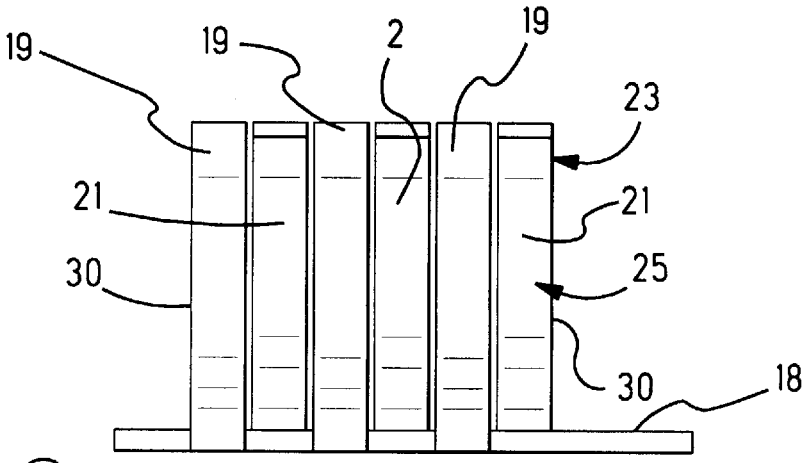
FIG. 9 is a side view of the electrical contact shown in FIG. 8.

With reference to FIGS. 9 and 10, each of the first spring fingers 19 are offset along the base 18 from each of the second spring fingers 21. The first spring fingers 19 on the side 24 of the electrical receptacle 23 oppose respective spaces 26 between the second spring fingers 21 on another side 25 of the electrical receptacle 23. Further, at least the first spring fingers 19 extend across the base 18 and project into the spaces 26 between the second spring fingers 21. The second spring fingers 21 project into additional respective spaces 26 between the first spring fingers 19.

Figure 2:
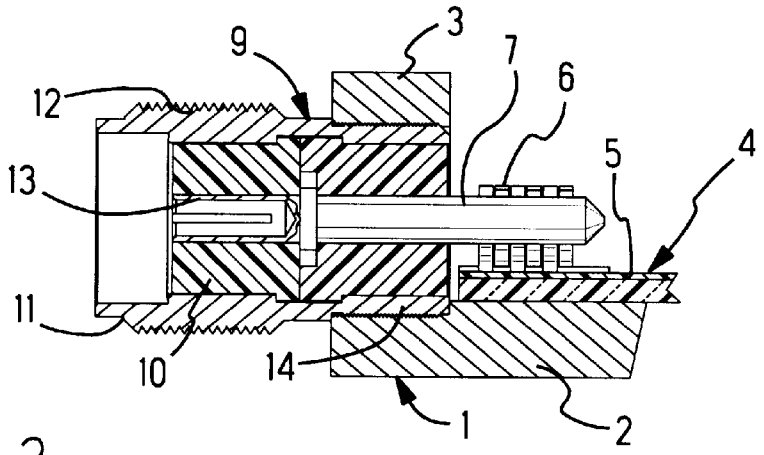
FIG. 2 is a view similar to FIG. 1, further illustrating the MIC package adapted with the coaxial connector in mating engagement with the electrical contact, as shown in FIG. 1.
Figure 3:
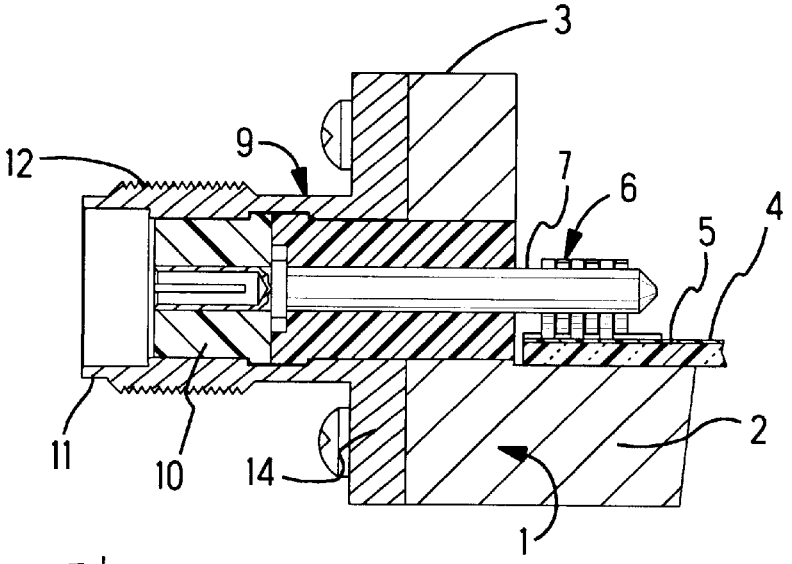
FIG. 3 is a view similar to FIG. 2 of another embodiment of a coaxial connector.
Figure 4:
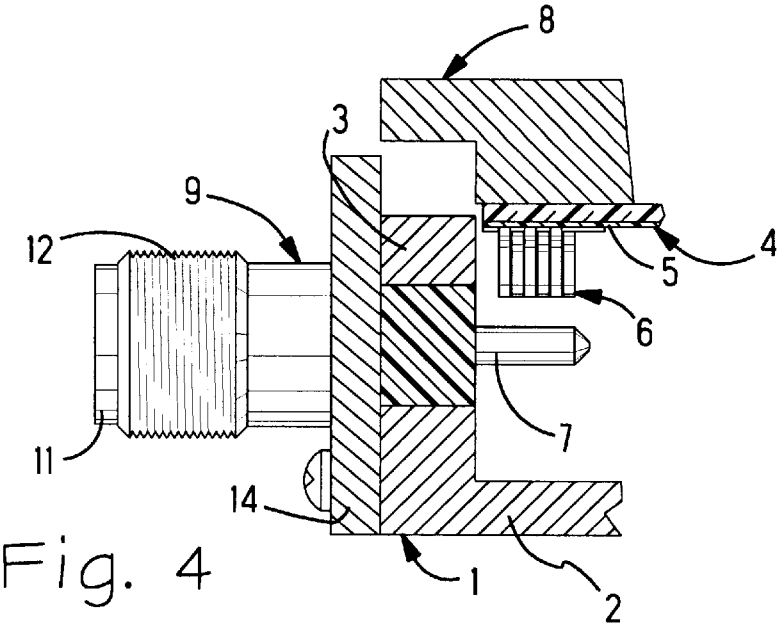
FIG. 4 is a view similar to FIG. 2 of another embodiment of an MIC package.

With reference to FIG. 8, the sides 24, 25 of the electrical receptacle 23 are outwardly bowed, by each of the spring fingers 19, 21 being outwardly bowed, to conform to the exterior of the center contact 7. Tips 27 of the spring fingers 19, 21 are bowed outwardly to define a flared first entrance 28 to a reduced throat 29 of the receptacle 23. This, first entrance 28, permits mating connection of the receptacle 23, as shown in FIG. 4, by movement of the receptacle 23 transversely with respect to the center contact 7. The receptacle 23 has open ends 30 at the outwardly bowed portion of the receptacle 23. At least one of the open ends 30 defines a second entrance of the receptacle 23. This, second entrance, permits mating connection of the receptacle 23, as shown in FIGS. 1–3, by movement of the receptacle 23 endwise and axially of the center contact 7. Mating connection is assured by the spring fingers 19, 21 frictionally engaging the center contact 7 with spring pressure.

The spring pressure results from resilient deflection of the spring fingers 19, 21 by engagement with the center contact 7. The spring fingers 19, 21 are lengthened to increase the amount of spring force, and to distribute internal stresses resulting from deflection. For example, as shown in FIG. 8, the first spring fingers 19 are lengthened, by extending across the base 18, and by extending beyond the second side 25 of the receptacle 23 to define the first side 24 of the receptacle 23.

The second side 25 of the receptacle 23 is defined by the second spring fingers 21. The second spring fingers 21 are lengthened, by extending across the base 18, and by extending beyond the first side 24 of the receptacle 23 to define the second side 25 of the receptacle 23. Accordingly, the first spring fingers 19 cross over the second side 25 of the receptacle 23 to define a first side 24 of the receptacle 23, and the second spring fingers 21 cross over the first side 24 of the receptacle 23 to define the second side 25 of the receptacle 23.

For example, each of the spring fingers 19, 21 has a length of about 0.125 inch, a width of about 0.025 inch, and a thickness of about 0.006 inch. The central axis of the open end 30 is about 0.056 inch from the bottom of the base 18. The inner diameter of 0.045 inch can expand to 0.050 inch to conform to the diameter of the center contact 7 of the coaxial connector 9. The first entrance 28 has a gap width of about 0.033 that flares to about 0.052 inch at the tips 27 of the spring fingers 19, 21. The gap width widens to allow passage of the center contact 7 into the receptacle 23, whereupon, the first entrance 28 will expand to about 0.050 inch and return to a gap width of about 0.034 to surround the center contact 7 with the receptacle 23. Forming the spring fingers 19, 21, as described above, will allow them to undergo elastic deflection to compensate for mating misalignment of the center contact 7, along the following axes; X axis 0.016 inch, Y axis 0.016 inch and Z axis 0.100 inch. The spring fingers 19, 21 undergo elastic deflection to avoid stress concentrations and consequent permanent distortion.

Figure 11:
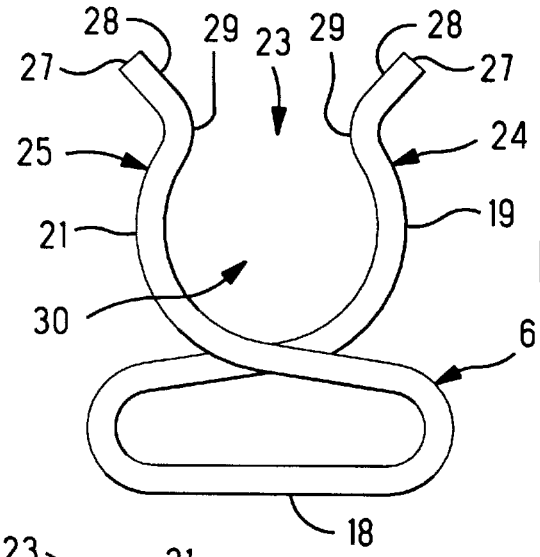
FIG. 11 is an end view of another embodiment of an electrical contact.
Figure 12:
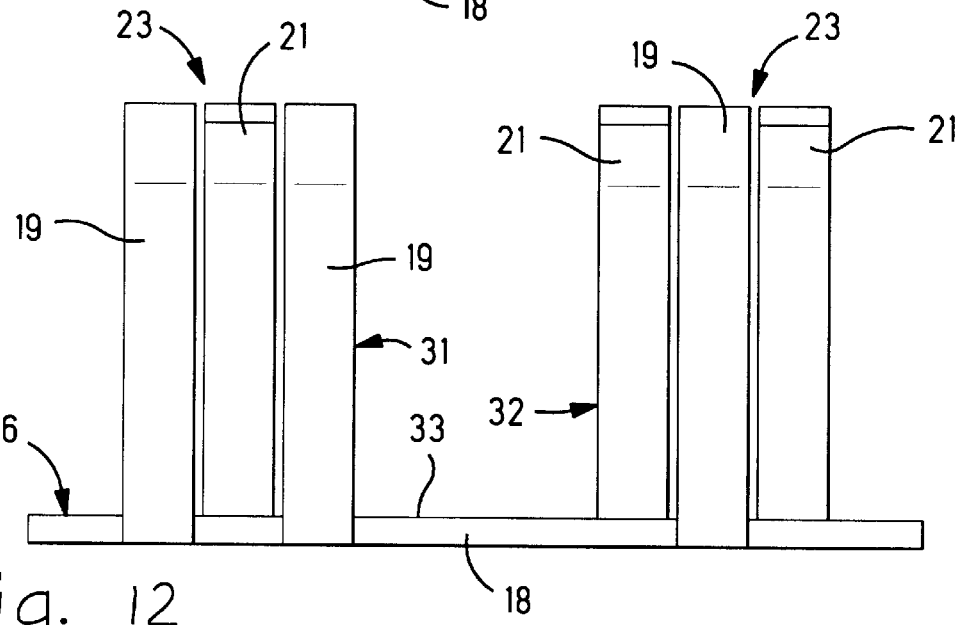
FIG. 12 is a side view of the electrical contact shown in FIG. 11.
Figure 13:
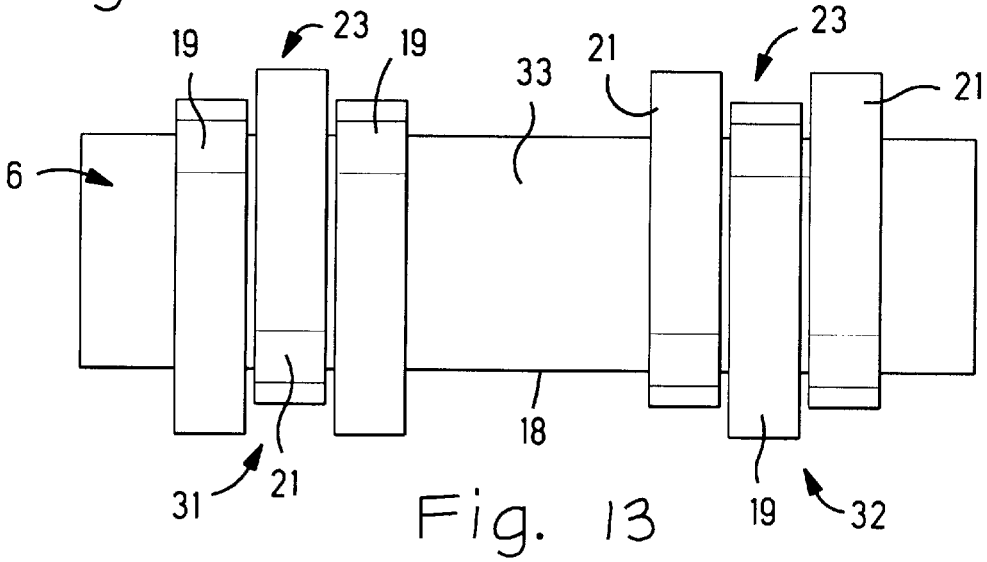
FIG. 13 is a top view of the electrical contact shown in FIGS. 11 and 12.

With reference to FIGS. 11, 12 and 13, another embodiment of the contact 6 will now be described. Each of the first spring fingers 19 are offset along the base 18 from each of the second spring fingers 21. The first spring fingers 19 on the side 24 of the electrical receptacle 23 oppose respective spaces 26 between the second spring fingers 21 on another side 25 of the electrical receptacle 23. Further, at least the first spring fingers 19 extend across the base 18 and project into the spaces 26 between the second spring fingers 21. The second spring fingers 21 project into additional respective spaces 26 between the first spring fingers 19.

A collective number of the spring fingers 19, 21 is equally divided into two groups 31, 32 that are spaced apart from each other along the length of the base 18. The spring fingers 19 are unequally divided into the two groups 31, 32. Similarly, the spring fingers 21 are unequally divided into the two groups 31, 32. The two groups 31, 32 are equally spaced from a centroid of the base 2. With the base 6 secured to the circuit board 4, in a manner described with reference to FIGS. 2, 3 and 4, the center contact 7 is inserted into at least one receptacle 23 formed by at least the spring fingers 19, 21 of one of the groups 31, 32 to establish an electrical connection. The second receptacle 23 is available for establishing another electrical connection. The two electrical receptacles 23 are in alignment with each other to enable connection to the same center contact 7. It the center contact 7 is sufficiently lengthy, the center contact 7 is inserted into the first and second receptacles 23 formed by the two groups 31, 32, respectively.

Between the two groups 31, 32 and on the base 18 is a vacuum pick up portion 33, for example, in the form of a flat surface, substantially at the centroid, to enable transport of the contact 6 by applying a vacuum from a known vacuum pick up tool to the vacuum pick up portion 33.

An advantage of the invention resides in an electrical receptacle 23 that compensates for mating misalignment along any of three orthogonal axes.

Another advantage of the invention resides in first and second sets of spring fingers 19, 21 defining opposite sides 24, 25 of an electrical receptacle 23, and resiliency of the spring fingers 19, 21 is improved by lengthening the spring fingers 19, 21 to cross over one another to opposite sides 24, 25 of the electrical receptacle 23.

Another advantage of the invention resides in a connect 6 having a vacuum pick up portion between two electrical receptacles.

Another advantage of the invention resides in first and second sets of spring fingers 19, 21 defining opposite sides 24, 25 of at least one electrical receptacle 23.

What is claimed is:

1. An electrical contact comprising: a base surface mounted to a circuit board, first spring fingers on a first edge of the base, and second spring fingers on a second edge of the base, the first spring fingers crossing the base and projecting into spaces between the second spring fingers, the second spring fingers crossing the base and projecting into spaces between the second spring fingers, whereby the first spring fingers and the second spring fingers cross over one another to opposite sides of an electrical receptacle, the first spring fingers crossing over a second of the opposite sides of the electrical receptacle and defining a first of the opposite sides of the electrical receptacle, the second spring fingers crossing over the first of the opposite sides and defining the second of the opposite sides.

2. An electrical contact as recited in claim 1 wherein, tips of the spring fingers are bowed outwardly to define a flared first entrance to the receptacle, whereby, mating connection of the receptacle with an electrical contact is permitted by relative movement of the receptacle in a direction transversely with respect to the electrical contact, and the receptacle having open ends, at least one of the open ends defining a second entrance of the receptacle, whereby, mating connection of the receptacle is permitted by relative movement of the receptacle endwise and in a direction axially of the electrical contact.

3. An electrical contact as recited in claim 1 wherein, the spring fingers are equally divided into two groups to define said electrical receptacle and a second electrical receptacle, the two groups are spaced equally from a centroid of the base, and a vacuum pick up portion is on the base substantially at the centroid to enable transport of the contact by applying a vacuum from a known vacuum pick up tool to the vacuum pick up portion.

4. An electrical contact comprising: a base surface mounted to with a circuit board, first spring fingers on a first edge of the base, second spring fingers on a second edge of the base, the first and second spring fingers being equally divided into two groups to define two electrical receptacles, the first spring fingers crossing over the second spring fingers and the second spring fingers crossing over the first spring fingers to define respective sides of said two electrical receptacles, the two electrical receptacles being spaced equally from a centroid of the base, and a vacuum pick up portion on the base substantially at the centroid, to enable transport of the contact by applying a vacuum from a known vacuum pick up tool to the vacuum pick up portion.

* * * * *